US007271551B1

(12) United States Patent
Cheng

(10) Patent No.: US 7,271,551 B1
(45) Date of Patent: Sep. 18, 2007

(54) DRIVER PROTECTION CIRCUIT FOR A PUSH-PULL TYPE DISCHARGE LAMP

(75) Inventor: Ying-Chang Cheng, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/603,134

(22) Filed: Nov. 22, 2006

(51) Int. Cl.
*G05F 1/00* (2006.01)

(52) U.S. Cl. ..... 315/291; 315/246

(58) Field of Classification Search ..... 315/246, 315/260, 265, 266, 276, 277, 287, 291; 361/18, 361/35, 77
See application file for complete search history.

(56) References Cited

U.S. PATENT DOCUMENTS

| | | | | |
|---|---|---|---|---|
| 6,329,763 | B1 * | 12/2001 | Pascente | 315/277 |
| 2002/0163315 | A1 * | 11/2002 | Kaneko et al. | 315/246 |
| 2004/0232853 | A1 * | 11/2004 | Hur et al. | 315/291 |
| 2005/0099139 | A1 * | 5/2005 | Gu et al. | 315/224 |

FOREIGN PATENT DOCUMENTS

| | | |
|---|---|---|
| TW | 557073 | 10/2003 |
| TW | 557074 | 10/2003 |
| TW | 559433 | 10/2003 |
| TW | 588917 | 5/2004 |
| TW | 591839 | 6/2004 |
| TW | 591976 | 6/2004 |
| TW | I242747 B | 11/2005 |

* cited by examiner

*Primary Examiner*—Trinh Dinh
*Assistant Examiner*—Tung X Le
(74) *Attorney, Agent, or Firm*—Birch, Stewart, Kolasch & Birch, LLP

(57) ABSTRACT

A driver protection circuit for a push-pull type discharge lamp comprises a discharge lamp with two input electrodes, a driver circuit having two transformer units and two driver units, and a protection mechanism. Two transformer units are respectively connected to the two input electrodes and provide an opposite-phase push-pull type driving power. The front ends of the transformer units are respectively connected to the driver units which are parallel connected to a power source. The combination of the driver unit, the transformer unit, and the input electrode is defined to be a high voltage output section. The protection mechanism has two protection units respectively assigned to the high voltage output sections and can receive an abnormal signal of the corresponding high voltage output section and synchronically transmits the abnormal signal to two driver units and makes the driver circuit simultaneously stop or pause outputting power to the two input electrodes.

10 Claims, 3 Drawing Sheets

DRIVER PROTECTION CIRCUIT FOR A PUSH-PULL TYPE DISCHARGE LAMP

FIELD OF THE INVENTION

The present invention relates to a driver protection circuit, particularly to a driver protection circuit for a push-pull type discharge lamp.

BACKGROUND OF THE INVENTION

To effectively promote the driving power for discharge lamps and improve the optical performance of discharge lamps, a push-pull type inverter inputs driving powers with a 180 degree phase difference therebetween to two input electrodes of a discharge lamp. Such an approach has been an important technical means in discharge lamp technologies. There are R.O.C. patent publications of No. 557073 and No. 557074 disclosing related technologies.

To obtain the sufficient brightness of liquid crystal panels and achieve the uniformity of the brightness on liquid crystal panels, the push-pull type inverter is usually used to drive multiple discharge lamps. In such a case, the conformability of the currents/the performance characteristics of the lamps is critical. Increasing the number of lamps will increase the number of driver units and will also increase the size of the circuit board of the driver units. Thus, the complexity and cost of fabricating the circuit board rises. There is a piezoelectric conversion/driver unit appearing in the market, wherein a driver unit is used to drive a conversion unit, a plurality of piezoelectric units and a plurality of loads. There are R.O.C. patent publications of No. 559433, No. 588917 and patent No. I242747 disclosing related technologies.

The driver circuit of the discharge lamp usually has arc discharge because of the imperfect contacts, the ambient temperature and humidity and the damaged parts. Therefore, there are various arc discharge protection devices appearing in the market. Refer to FIG. 1 a diagram schematically showing the architecture of a conventional arc discharge protection circuit. As shown in FIG. 1, a PWM (Pulse Width Modulation) controller 10, a switch 22 and a voltage booster 24 are arranged before each discharge lamp 26 and used to control the driving power transmitted from a power source to the discharge lamp 26. The region between one switch 22 and the input electrode of the corresponding discharge lamp 26 is defined to be a high voltage output section 20. Each high voltage output section 20 has an arc discharge protection device 30 used to detect arc discharge. Once detecting a signal of arc discharge, the arc discharge protection device 30 sends a power-shutting signal to the PWM controller 10 to entirely stop or pause outputting driving power to the discharge lamp 26. There are R.O.C. patent publications of No. 591976 and No. 591839 disclosing related technologies.

However, when the abovementioned arc discharge protection device is applied to the abovementioned push-pull type inverter or the abovementioned multiple-load driving circuit, it cannot perform an appropriate switch-off action when one single lamp of a liquid crystal panel or the transformer thereof is abnormal. For example, when the abovementioned arc discharge protection device is applied to the abovementioned multiple-load driving circuit, and when any one of the loads is abnormal, the arc discharge protection circuit switches off the multiple-load driving circuit; thus, all the lamps of the liquid crystal panel are shut off, and the whole liquid crystal panel fails. When the abovementioned arc discharge protection device is applied to the abovementioned push-pull type inverter, and when the driver circuit at one input electrode side of a single arc lamp is abnormal, the abovementioned arc discharge protection circuit will only stop or pause the operation of the driver circuit at the abovementioned input electrode side, but the driver circuit at the other input electrode side persists in inputting driving power to the discharge lamp; thus, the related electronic devices are likely to be damaged.

SUMMARY OF THE INVENTION

The primary objective of the present invention is to provide a driver protection circuit for a push-pull type discharge lamp, wherein when one high voltage output section, which corresponds to one of two input electrodes, generates an abnormal signal, the protection unit corresponding to the high voltage output section will synchronically transmit the abnormal signal to the driver units, and the driver circuit will stop or pause outputting power to the two input electrodes of the discharge lamp; thus, none power continues to drive the discharge lamp, and the related electronic devices can be free from damage.

To achieve the abovementioned objective, the present invention proposes a driver protection circuit for a push-pull type discharge lamp, which comprises a discharge lamp, a driver circuit, and a protection mechanism. The discharge lamp has two input electrodes. The driver circuit has two transformer units and two driver units; the two transformer units are respectively connected to the two input electrodes of the discharge lamp and provide an opposite-phase push-pull type driving power for the discharge lamp. The front ends of the transformer units are respectively connected to the driver units, and the driver units are parallel connected to a power source. The combination of one driver unit, one transformer unit, and one input electrode is defined to be a high voltage output section. The protection mechanism has two protection units, and the protection units are respectively assigned to the two high voltage output sections. The protection unit can receive an abnormal signal of the corresponding high voltage output section and synchronically transmits the abnormal signal to the two driver units and makes the driver circuit simultaneously stop or pause outputting power to the two input electrodes of the discharge lamp so that none power will continue to drive the discharge lamp.

DETAILED DESCRIPTION OF THE PREFERRED EMBODIMENTS

The technical contents of the present invention are to be described in detail in cooperation with the drawings below.

Figure 1:
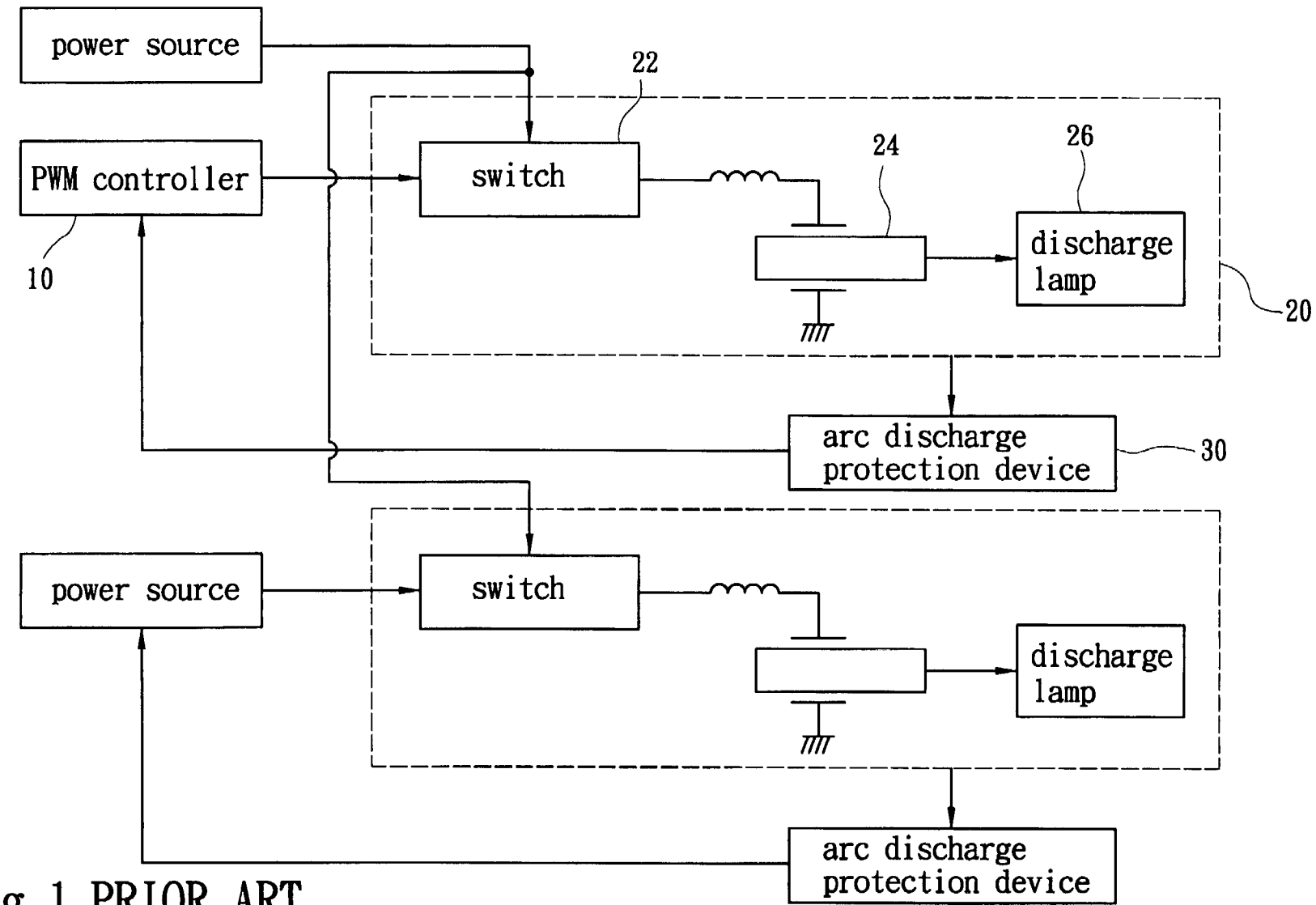
Fig. 1 PRIOR ART
FIG. 1 is a block diagram schematically showing the architecture of a conventional technology.
Figure 2:
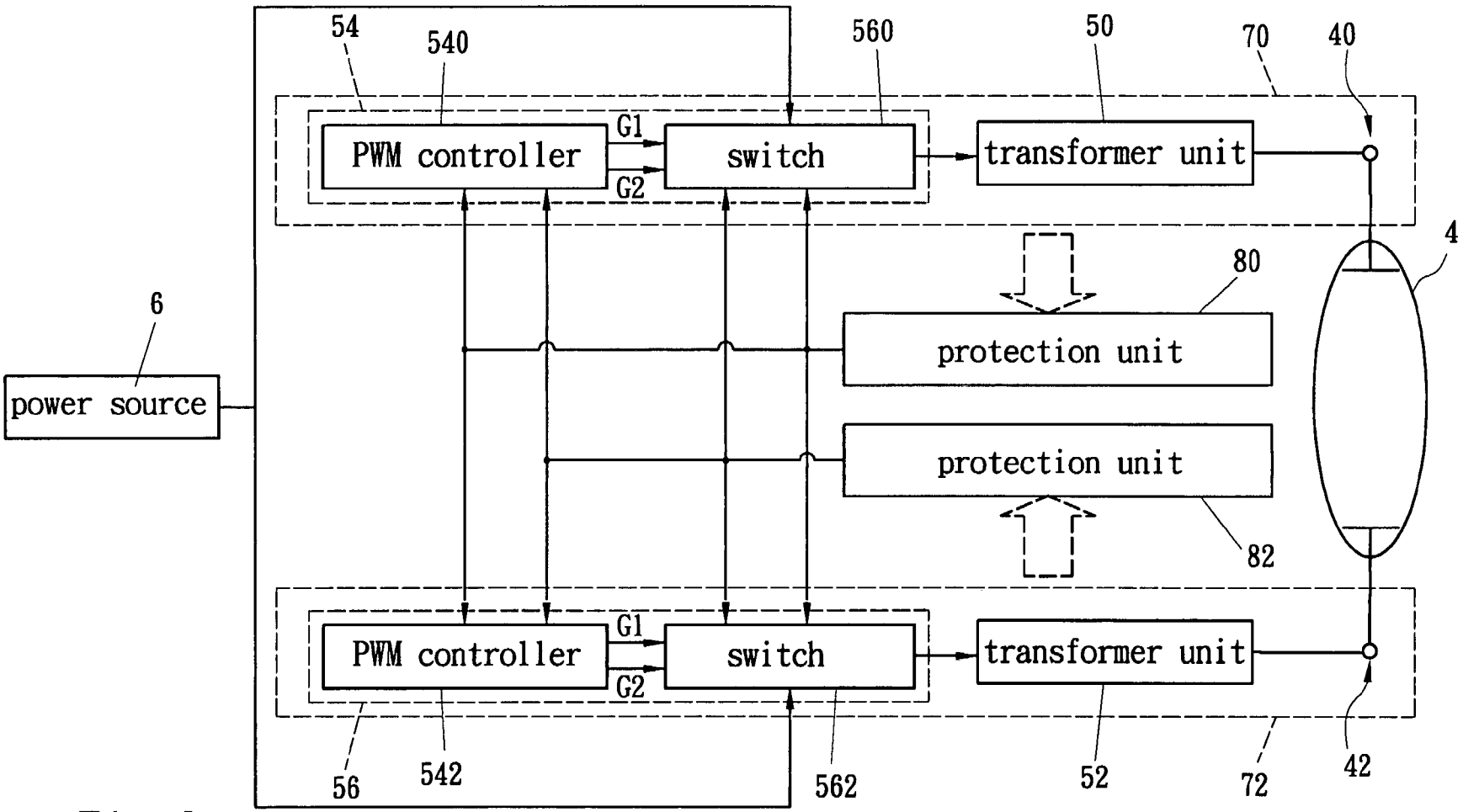
FIG. 2 is a block diagram schematically showing the architecture of a first embodiment of the present invention.

Refer to FIG. 2 a block diagram schematically showing the architecture of a first embodiment of the present invention. As shown in FIG. 2, the driver protection circuit for a push-pull type discharge lamp of the present invention comprises:

a discharge lamp 4 having two input electrodes 40 and 42;

a driver circuit having two transformer units 50 and 52 and two driver units 54 and 56, wherein the two transformer units 50 and 52 are respectively connected to the two input electrodes 40 and 42 of the discharge lamp 4 and provide an opposite-phase push-pull type driving power for the discharge lamp 4; the front ends of the transformer units 50 and 52 are respectively connected to the driver units 54 and 56; the driver units 54 and 56 are parallel connected to a power source 6; the combination of the driver unit 54/56, the transformer unit 50/52, and the input electrode 40/42 is defined to be a high voltage output section 70/72; in this embodiment, the driver unit 54/56 further comprises a PWM (Pulse Width Modulation) controller 540/542 outputting frequency signals G1 and G2 and a switch 560/562 receiving the frequency signals G1 and G2; and a protection mechanism having two protection units 80 and 82, wherein the two protection units 80 and 82 are respectively assigned to the two high voltage output sections 70 and 72; the protection unit 80/82 can receive an abnormal signal of the corresponding high voltage output section 70/72 and synchronically transmits the abnormal signal to the two driver units 54 and 56 and makes the driver circuit simultaneously stop or pause outputting power to the two input electrodes 40 and 42 of the discharge lamp 4 so that none power will continue to drive the discharge lamp 4; in this embodiment, the protection unit 80/82 receives an abnormal signal of the corresponding high voltage output section 70/72 and synchronically transmits the abnormal signal to the PWM controllers 540 and 542 or the switches 560 and 562 to make the driver units 54 and 56 stop or pause outputting power.

When the high voltage output section 70/72 corresponding to the input electrode 40/42 of the discharge lamp 4 generates an abnormal signal, the protection unit 80/82 corresponding to the high voltage output section 70/72 synchronically transmits the abnormal signal to the driver units 54 and 56 and makes the driver circuit simultaneously stop or pause outputting power to the two input electrodes 40 and 42 of the discharge lamp 4 lest the high voltage output section 72/70 free from malfunction should persist in outputting power to the corresponding input electrode 42/40. Thus, the related electronic devices can be free from damage.

The protection unit 80/82 may use an electrode plate (not shown in the drawings) to receive the abnormal signal of the high voltage output section 70/72, as disclosed in the R.O.C. patent No. 591839. Then, the protection unit 80/82 sends the abnormal signal to a trigger unit (not shown in the drawings), which is connected to the electrode plate and the driver units 54 and 56. After receiving the abnormal signal, the trigger unit synchronically sends two trigger signals respectively to the PWM controllers 540 and 542 or the switches 560 and 562 to make the driver units 54 and 56 stop or pause outputting power.

The protection unit 80/82 may use a rectifier unit (not shown in the drawings) to receive the abnormal signal of the high voltage output section 70/72, as disclosed in the R.O.C. patent No. 591976. Then, the protection unit 80/82 sends the abnormal signal to a trigger unit (not shown in the drawings), which is connected to the rectifier unit and the driver units 54 and 56. After receiving the abnormal signal, the trigger unit synchronically sends two trigger signals respectively to the PWM controllers 540 and 542 or the switches 560 and 562 to make the driver units 54 and 56 stop or pause outputting power.

Figure 3:
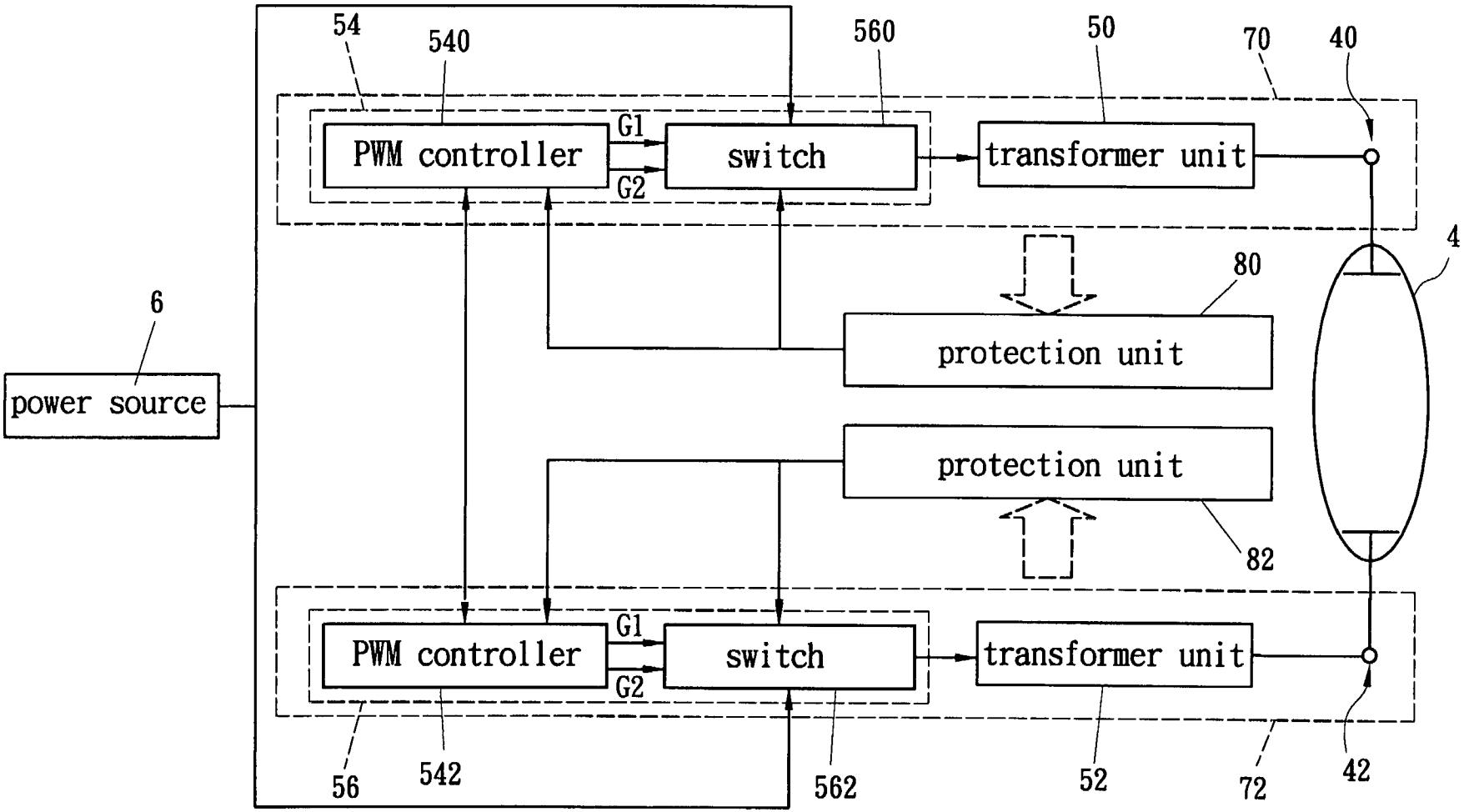
FIG. 3 is a block diagram schematically showing the architecture of a second embodiment of the present invention.

Refer to FIG. 3 a block diagram schematically showing the architecture of a second embodiment of the present invention. This embodiment is different from the former embodiment in the path of transmitting the abnormal signal. In this embodiment, after receiving an abnormal signal, the protection unit 80 sends the abnormal signal to the driver unit 54; the driver unit 54 further sends the abnormal signal to the driver unit 56, and then both the driver units 54 and 56 stop or pause outputting power. In this embodiment, the design of the protection unit 82 is equivalent to that of the protection unit 80. After receiving an abnormal signal, the protection unit 82 sends the abnormal signal to the driver unit 56; the driver unit 56 further sends the abnormal signal to the driver unit 54, and then both the driver units 54 and 56 stop or pause outputting power.

In this embodiment, the protection unit 80/82 sends the abnormal signal to the driver unit 54/56; the driver unit 54/56 further sends the abnormal signal to the driver unit 56/54, and then the driver circuit stops or pauses outputting power to the two input electrodes 40 and 42 of the discharge lamp 4.

Summarily, in the present invention, the two protection units 80 and 82 are respectively assigned to the two high voltage output sections 70 and 72 respectively corresponding to the two input electrodes 40 and 42 of the discharge lamp 4 and used to detect abnormal signals; after detecting an abnormal signal, the protection unit 80/82 synchronically sends the abnormal signal to the two driver units 54 and 56 respectively arranged before the two input electrodes 40 and 42 of the discharge lamp 4; when either of the high voltage output sections 70 and 72 respectively corresponding to the two input electrodes 40 and 42 of the discharge lamp 4 is abnormal, both the input electrodes 40 and 42 simultaneously stop or pause providing power for the discharge lamp 4. The present invention can prevent the liquid crystal panel from entirely malfunctioning. The present invention can also prevent the normal high voltage output section 70/72 from persisting in outputting power when the other high voltage output section 72/70 has been abnormal; thus, the related electronic device can be from damage. Therefore, the present invention indeed possesses novelty and non-obviousness and meets the conditions of a patent. Thus, the inventor files the application for a patent. It will be greatly appreciated that the patent should be approved fast.

Those described above are the preferred embodiments to exemplify the present invention. However, it is not intended to limit the scope of the present invention. Any equivalent modification and variation according to the spirit of the present invention is to be also included within the scope of the present invention.

What is claimed is:

1. A driver protection circuit for a push-pull type discharge lamp, comprising:

a discharge lamp having two input electrodes;

a driver circuit having two transformer units and two driver units, wherein said two transformer units are respectively connected to said two input electrodes of said discharge lamp and provide an opposite-phase push-pull type driving power for said discharge lamp; the front ends of said transformer units are respectively connected to said driver units; said driver units are parallel connected to a power source; the combination of said driver unit, said transformer unit, and said input electrode is defined to be a high voltage output section; and a protection mechanism having two protection units, wherein said protection units are respectively assigned to said high voltage output sections; said protection unit can receive an abnormal signal of the corresponding said high voltage output section and synchronically transmits said abnormal signal to said driver units and makes said driver circuit simultaneously stop or pause outputting power to said two input electrodes of said discharge lamp so that none power will continue to drive said discharge lamp.

2. The driver protection circuit for the push-pull type discharge lamp according to claim 1, wherein said driver unit further comprises a PWM controller and a switch.

3. The driver protection circuit for the push-pull type discharge lamp according to claim 2, wherein said protection unit utilizes an electrode plate to receive an abnormal signal of said high voltage output section; then, said protection unit sends said abnormal signal to a trigger unit, which is connected to said electrode plate and said driver units; after receiving said abnormal signal, said trigger unit synchronically sends two trigger signals respectively to said driver units to stop or pause outputting power.

4. The driver protection circuit for the push-pull type discharge lamp according to claim 3, wherein said trigger unit synchronically sends said two trigger signals respectively to said PWM controllers of said driver units.

5. The driver protection circuit for the push-pull type discharge lamp according to claim 3, wherein said trigger unit synchronically sends said two trigger signals respectively to said switches of said driver units.

6. The driver protection circuit for the push-pull type discharge lamp according to claim 2, wherein said protection unit utilizes a rectifier unit to receive an abnormal signal of said high voltage output section; then, said protection unit sends said abnormal signal to a trigger unit, which is connected to said rectifier unit and said driver units; after receiving said abnormal signal, said trigger unit synchronically sends two trigger signals respectively to said driver units to stop or pause outputting power.

7. The driver protection circuit for the push-pull type discharge lamp according to claim 6, wherein said trigger unit synchronically sends said two trigger signals respectively to said PWM controllers of said driver units.

8. The driver protection circuit for the push-pull type discharge lamp according to claim 6, wherein said trigger unit synchronically sends said two trigger signals respectively to said switches of said driver units.

9. The driver protection circuit for the push-pull type discharge lamp according to claim 1, wherein said driver units are interconnected; once either of said protection units detects the abnormal signal, the corresponding said driver unit sends said abnormal signal to the other said driver unit, and said driver circuit thus stops or pauses outputting power to said two input electrodes of said discharge lamp.

10. The driver protection circuit for a push-pull type discharge lamp according to claim 1, wherein when one individual said protection unit detects the abnormal signal from the corresponding said high voltage output section, said protection unit synchronically transmits said abnormal signal to all said driver units to stop or pause outputting power to said two input electrodes of said discharge lamp.

* * * * *